US008950294B2

(12) United States Patent
Wang

(10) Patent No.: US 8,950,294 B2
(45) Date of Patent: Feb. 10, 2015

(54) RATCHET WRENCH APPLICABLE TO MULTI-SIZE WORKPIECES

(76) Inventor: Yeo-Ming Wang, Taipei (TW)

( * ) Notice: Subject to any disclaimer, the term of this patent is extended or adjusted under 35 U.S.C. 154(b) by 337 days.

(21) Appl. No.: 13/426,350

(22) Filed: Mar. 21, 2012

(65) Prior Publication Data

US 2013/0247724 A1 Sep. 26, 2013

(51) Int. Cl.
*B25B 13/46* (2006.01)

(52) U.S. Cl.
USPC ..... 81/60; 81/63.1; 81/63.2

(58) Field of Classification Search
USPC ..... 81/60–63.2, 448
See application file for complete search history.

(56) References Cited

U.S. PATENT DOCUMENTS 2,879,681 A * 3/1959 Blasdell ..... 81/179
2,937,551 A * 5/1960 Akers ..... 81/179
4,838,132 A 6/1989 Pyles
5,533,428 A * 7/1996 Pradelski ..... 81/179
5,768,958 A * 6/1998 Gamble ..... 81/58.2
7,077,035 B1 * 7/2006 Huang ..... 81/179
7,827,887 B2 * 11/2010 Lee ..... 81/179
8,402,866 B2 * 3/2013 Hu ..... 81/179
2007/0119281 A1 * 5/2007 Chang ..... 81/179

* cited by examiner

*Primary Examiner* — Monica Carter
*Assistant Examiner* — Danny Hong
(74) *Attorney, Agent, or Firm* — Muncy, Geissler, Olds & Lowe, P.C.

(57) ABSTRACT

A ratchet wrench applicable to multi-size workpieces comprises: a wrench with a handle and a head wherein the head has a hollow handle hole in which there are two neighboring surfaces along its inner edge, a first support surface and a second support surface, and an accommodating space embedded into the handle; a support portion with a ratchet part and a resilient member wherein the ratchet part allows one end to be pivoted in the accommodating space and is provided with an arc-convex portion, which is within the hollow handle hole for a first working space developed inside, and the resilient member always exerts a resilient resistance on the ratchet part. As such, the ratchet wrench depends on a simple mechanism and is applicable to continuous screw operation of various screw fastening elements for excellent convenience and swiftness.

6 Claims, 6 Drawing Sheets

RATCHET WRENCH APPLICABLE TO MULTI-SIZE WORKPIECES

BACKGROUND OF THE INVENTION

1. Field of the Invention

The present invention relates to a ratchet wrench, especially a ratchet wrench which is adjustably applicable to various screws fastening elements as well as continuously and easily turned in operation.

2. Description of the Related Art

The ratchet wrench is a common hand tool. As shown in FIG. 1, a conventional ratchet wrench 90 comprises a handle 91 and a head 92 on which there is a hollow working portion 93 with tooth tips 921 on its edge. With a screw fastening element (e.g., a sleeve or a nut not shown in the figure) placed in the hollow working portion 93 during operation, the handle 91 is turned to drive the head 92 for the screw fastening element screwed. Notwithstanding the foregoing, the conventional ratchet wrench 90 is not taken as an economic design because of a fixed size of its hollow working portion 93, which must fit one screw fastening element with a corresponding size, or preparation of alternative ratchet wrenches 90 with multiple hollow working portions 93 for all types of screw fastening elements to be screwed. Therefore; a ratchet wrench 90 applicable to any screw fastening element's distinct size has been designed, for example, Adjustable Wrench (U.S. Pat. No. 4,838,132) is provided with a moveable jaw member, which is moved within the head's hollow working portion to contact a screw fastening element to be screwed, and depends on its adjustable forward or backward status to change the hollow working portion's inner space and fit a distinct screw fastening element.

Notwithstanding the previously mentioned patent which is effective in regulating a moveable jaw member's moving direction, forward or backward, and applicable to multiple screw fastening elements and features economic efficiency to simplify the quantity of tools, the patent still has some drawbacks, for instance, the adjustable wrench based on the moveable jaw member for screw operation of multiple screw fastening elements is not an ideal design obviously because it is complicated and wasteful of time during operation and is not stable with a larger screw fastening element held by the moveable jaw member in a comparatively smaller range of screw operation. Additionally, it is rather inconvenient to operate the patent adjustable wrench, for example, the shifted moveable jaw member must be readjusted with the adjustable wrench failing to be turned 360 degrees in a limited working space and withdrawn again to acquire a working space prepared for next screwing. That is, the patent adjustable wrench is not provided with a mechanism designed to be constantly operated and deserves to be corrected. Thus, how to eliminate drawbacks of a ratchet wrench based on the prior art in use should be one issue to be solved or overcome by the industry or talents.

Considering drawbacks and an unideal design of a ratchet wrench based on the prior art, the inventor exerted himself to study solutions and develop a fast-operated, convenient and adjustable ratchet wrench favorable to the general public and progress of the industry and created this invention after long-term thinking.

SUMMARY OF THE INVENTION

The object of the present invention is to provide a simple mechanism or configuration which facilitates convenient and economic screw operation of various screw fastening elements.

The other object of the present invention is to provide a continuous screw operation and realize screws conveniently and fast tightened and connected.

The present invention with technical measures to realize the above objects comprises: (a) a wrench with a handle and a head wherein the head has a hollow handle hole in which there are two bended neighboring surfaces at its inner edge, a first support surface and a second support surface, as well as an accommodating space embedded in the handle and the handle has a pivot hole penetrating the accommodating space; (b) a support portion with a ratchet part and a resilient member wherein the ratchet part is provided with (1) a pin joint part at its end and within the accommodating space and (2) an arc-convex portion with tooth tips and within the hollow handle hole for a first working space developed in the hollow handle hole and the resilient member is placed in the accommodating space and always exerts resilient resistance on the ratchet part.

For technical features and effects of the present invention further comprehended and understood, the preferred embodiments with reference drawings are shown in the descriptions hereinafter.

DETAILED DESCRIPTIONS OF THE PREFERRED EMBODIMENTS

Referring to FIG. 2 and FIG. 3 which illustrate the present invention of a ratchet wrench applicable to multi-size workpieces comprises a wrench 10 and a support portion 20; the wrench 10 with a handle 11 and a head 12 wherein the head 12 has a hollow handle hole 13 in which there are some surfaces continuously arranged on its edge, i.e., an arc-edge surface 121, a first support surface 122 and a second support surface 123, and the first support surface 122 and the second support surface 123 form two bended straight surfaces adjacent to each other, that is, an obtuse angle (120 degrees in this embodiment) developed in between. At the area of the hollow handle hole 13 contiguous to the handle 11, the head 12 is provided with an accommodating space 14 embedded in the handle 11 and the handle 11 beside the hollow handle hole 13 is provided with a pivot hole 111 penetrating the accommodating space 14. In the accommodating space 14, there is a support portion of accommodating space 141, either a raised piece or a groove, which is located beside the pivot hole 111.

The support portion 20 comprises a ratchet part 21 and a resilient member 22: the ratchet part 21 is provided with (a) a pin joint part 210 at one end on which there is a fish-eye pin joint hole 211 and (b) a support portion of ratchet 215, either a raised piece or a groove, adjacent to the pin joint hole 211; the ratchet part 21 comprises two portions, an arc-convex portion 212 and an arc-concave portion 213, on opposite ends wherein the arc-convex portion 212 is designed to form tooth tips 214 which facilitate more frictional resistance and incline to a specific direction, e.g., the arc-edge surface 121 in this embodiment. During assembly of the ratchet part 21 and the handle 11, the ratchet part 21 should be inserted into the accommodating space 14, allowing the pin joint hole 211 to align a pivot hole 111 of the handle 11, a pin 23 to be held in the pivot hole 111 as well as the pin joint hole 211, and two fixing parts 112 to fasten two fixing ends 231 of the pin 23 for the pin joint part 210 of the ratchet part 21 pivoted in the accommodating space 14 and both the arc-convex portion 212 and the arc-concave portion 213 of the ratchet part 21 accommodated in the hollow handle hole 13 of the head 12 as shown in FIG. 2. To supply an elastic force always resisting the ratchet part 21, the resilient member 22 held in the accommodating space 14 (or wound on the pin 23 in this embodiment) is provided with a first resilient part 221 and a second resilient part 222 which resist and contact the support portion of accommodating space 141 and the support portion of ratchet 215 of the ratchet part 21, respectively; in a preferred embodiment, the resilient member 22 can be developed to be an alternative shape or style. In addition, the ratchet part 21 with the resilient member 22 assembled divides the hollow handle hole 13 into a first working space 131 and a second working space 132 which correspond to the arc-convex portion 212 (tooth tips 214) and the arc-concave portion 213, respectively.

Referring to FIG. 4 which illustrates the present invention of a ratchet wrench applicable to multi-size workpieces is in operation. A screw fastening element 30 (e.g., a hexagon nut in this embodiment) to be handled is placed in the first working space 131 in the hollow handle hole 13 for two neighboring surfaces of the screw fastening element 30 contacting both the first support surface 122 and the second support surface 123 and an opposite surface of the screw fastening element 30 contacting the arc-convex portion 212 (tooth tips 214) of the ratchet part 21. As such, the handle 11 is turned clockwise (as the solid arrow in FIG. 4) for torsion applied on and screwing the screw fastening element 30 due to the first support surface 122 and the second support surface 123 collectively turned. In this embodiment, the screw fastening element 30 can be either a sleeve or a bolt.

Also, the handle 11 can be turned counterclockwise (as the dotted arrow "N" in FIG. 4) and finally retrograded because torsion out of the first support surface 122 and the second support surface 123 is unavailable to the screw fastening element 30 (on which torsion is not applied); the handle 11 keeps its working space for next screwing due to the screw fastening element 30 not screwed anymore. Continuously, the handle 11 is turned clockwise again (as the solid arrow in FIG. 4) to further tighten the screw fastening element 30 and effectively complete continuous operation without the head 12 removed from the screw fastening element 30. Furthermore, the screw fastening element 30 is not unscrewed because the ratchet part 21 depends on resistance from the resilient member 22 to continuously contact the screw fastening element 30 with the handle 11 turned counterclockwise and no torsion applied on the screw fastening element 30.

Referring to FIG. 5 which illustrates the screw fastening element 30 to be unscrewed based on the same principle wherein the reversed wrench 10 covers the screw fastening element 30 and the handle 11 is turned counterclockwise (as shown in the solid arrow) to unscrew the screw fastening element 30 or turned clockwise (as shown in the dotted arrow "N") to keep the screw fastening element 30 immobile and procure some advantages such as space to further manipulate the handle 11 in the next turn and the screw fastening element 30 disassembled continuously and simply without the head 12 removed from the screw fastening element 30.

Referring to FIG. 6 which illustrates the present invention of a ratchet wrench applicable to multi-size workpieces wherein the ratchet part 21 is pivoted and resisted by the resilient member 22 so that the yawing ratchet part 21 facilitates various first working spaces 131, fits multi-size screw fastening elements 30 (30A, 30B), each of which is positioned by the first support surface 122 and the second support surface 123, and realizes excellent, fast and convenient operation and adjustment by pivoting the ratchet part 21.

As such, the present disclosure of a ratchet wrench which is constructed with a simple mechanism previously mentioned and applicable to multi-size screw fastening elements features and facilitates convenience and economy of screw operation.

It can be seen from the above descriptions that the present invention significantly meets patentability and is applied for the patent. However, the above descriptions present preferred embodiments only which do not limit the scope of the present invention; any equivalent change or improvement based on shapes, structures, features and spirit mentioned in the present invention should be incorporated in claims.

BRIEF DESCRIPTIONS OF THE DRAWINGS

Figure 1:
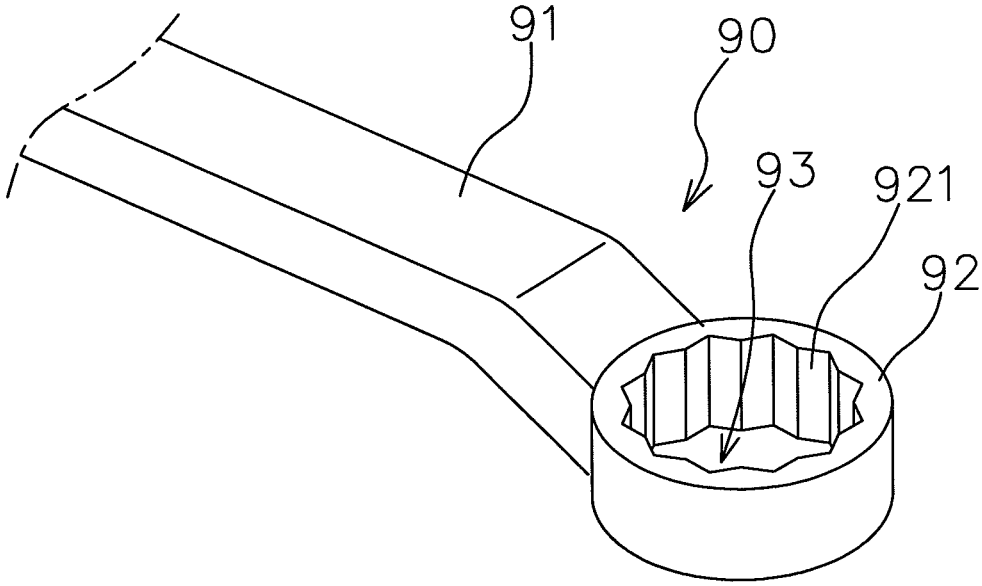
FIG. 1 (PRIOR ART)
FIG. 1 is the schematic illustration of a conventional ratchet wrench.
Figure 2:
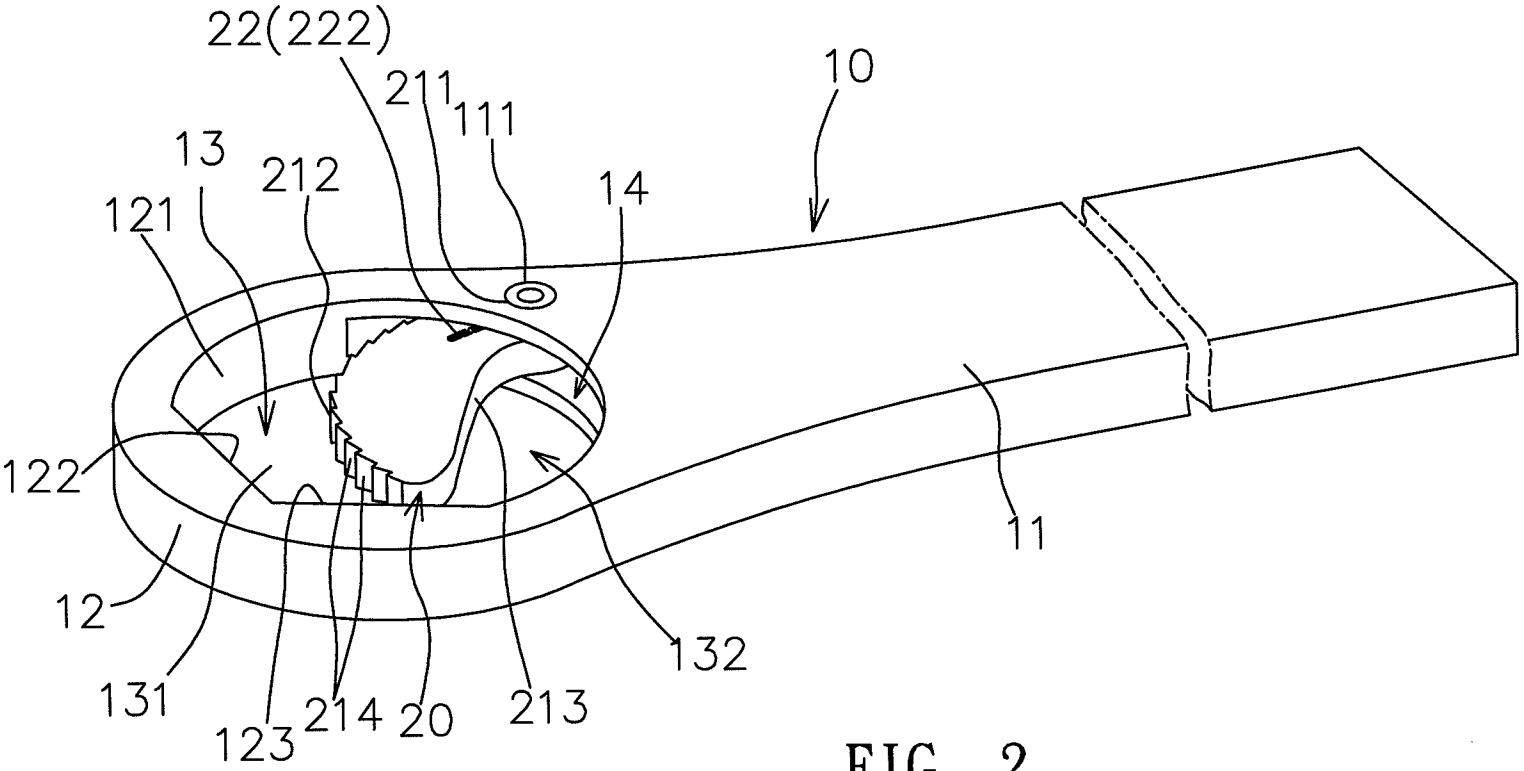
FIG. 2 illustrates the present invention of an assembled ratchet wrench.
Figure 3:
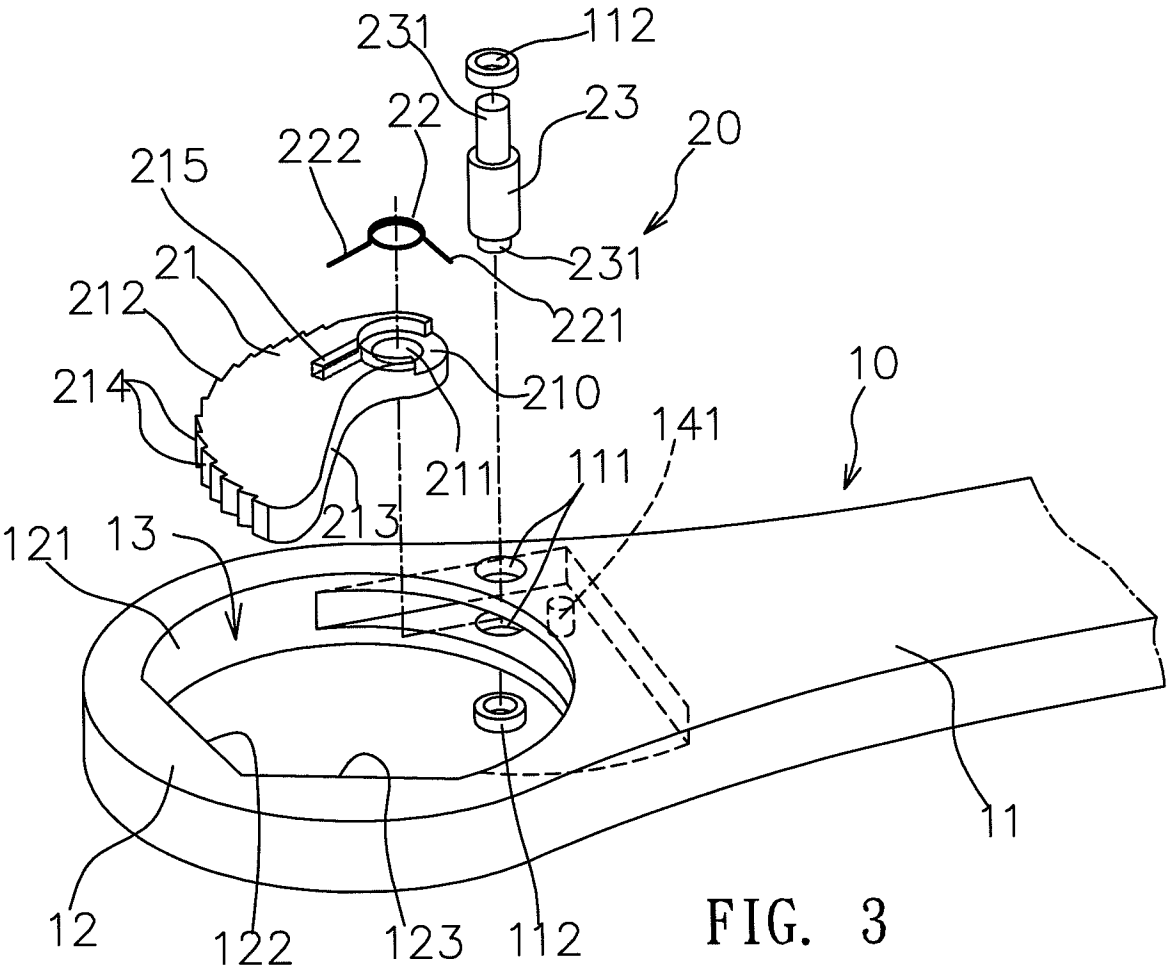
FIG. 3 is the exploded view of the present invention of a ratchet wrench.
Figure 4:
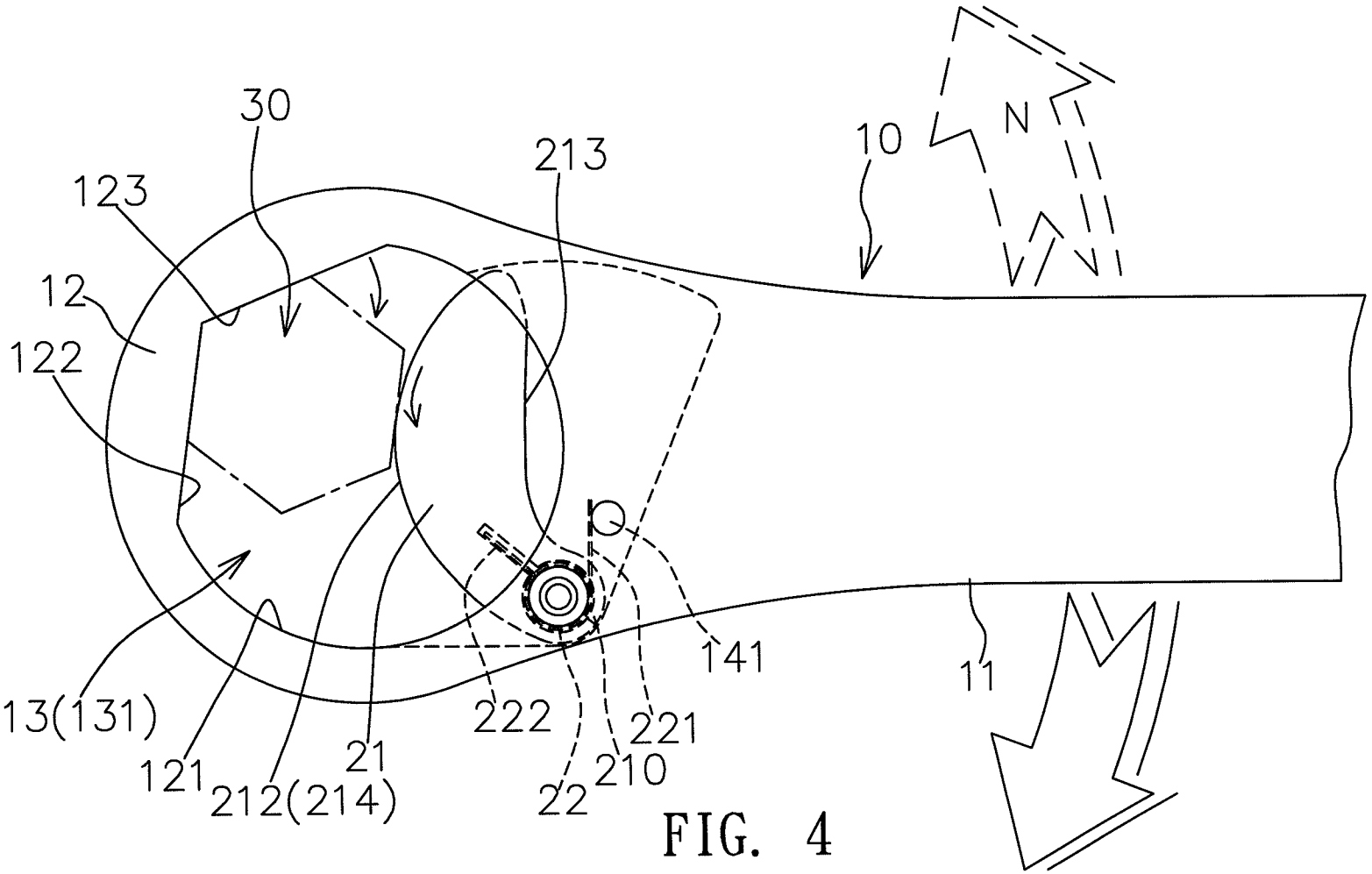
FIG. 4 is the first schematic illustration of the present invention of a ratchet wrench in operation.
Figure 5:
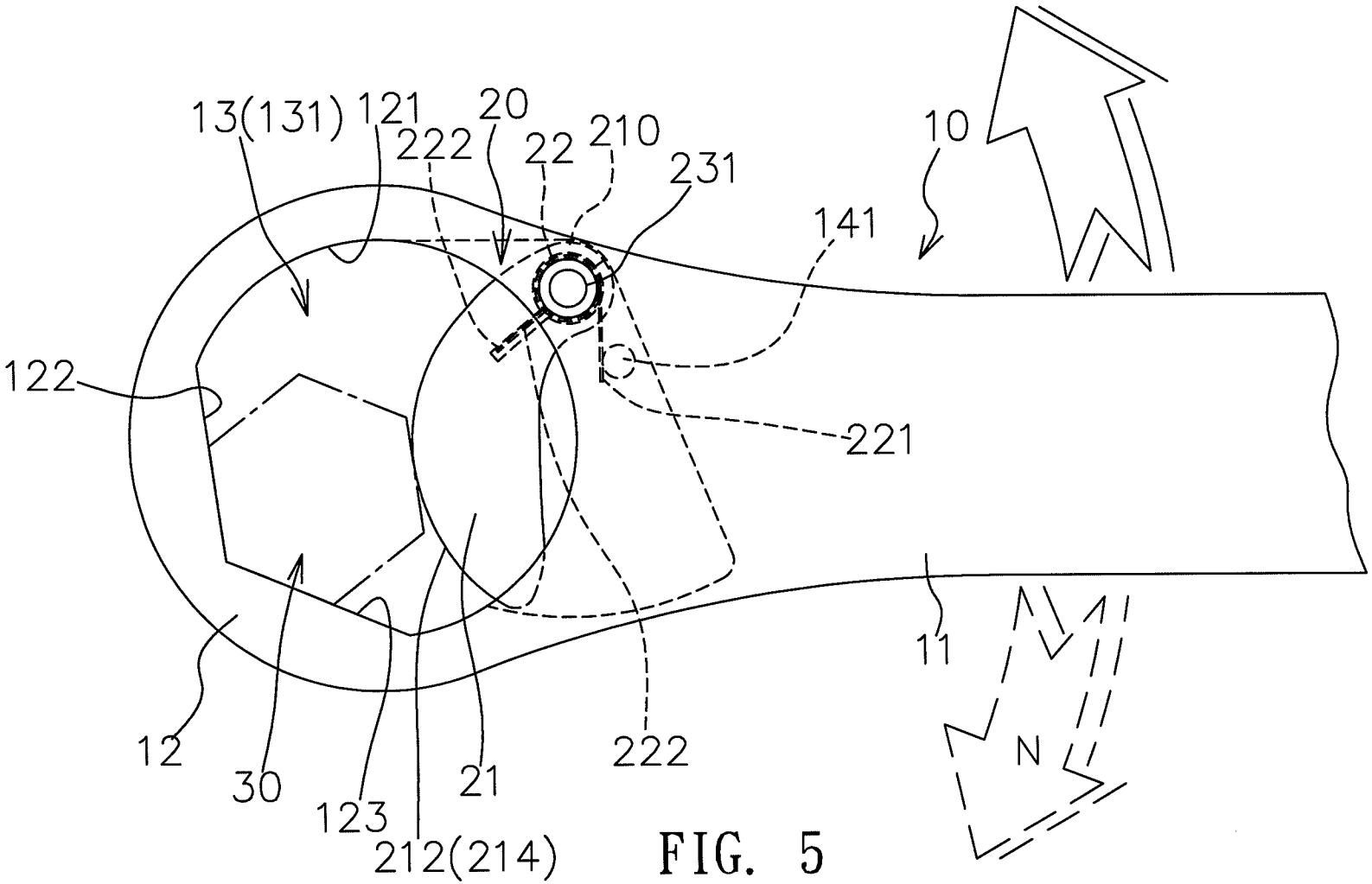
FIG. 5 is the second schematic illustration of the present invention of a ratchet wrench in operation.
Figure 6:
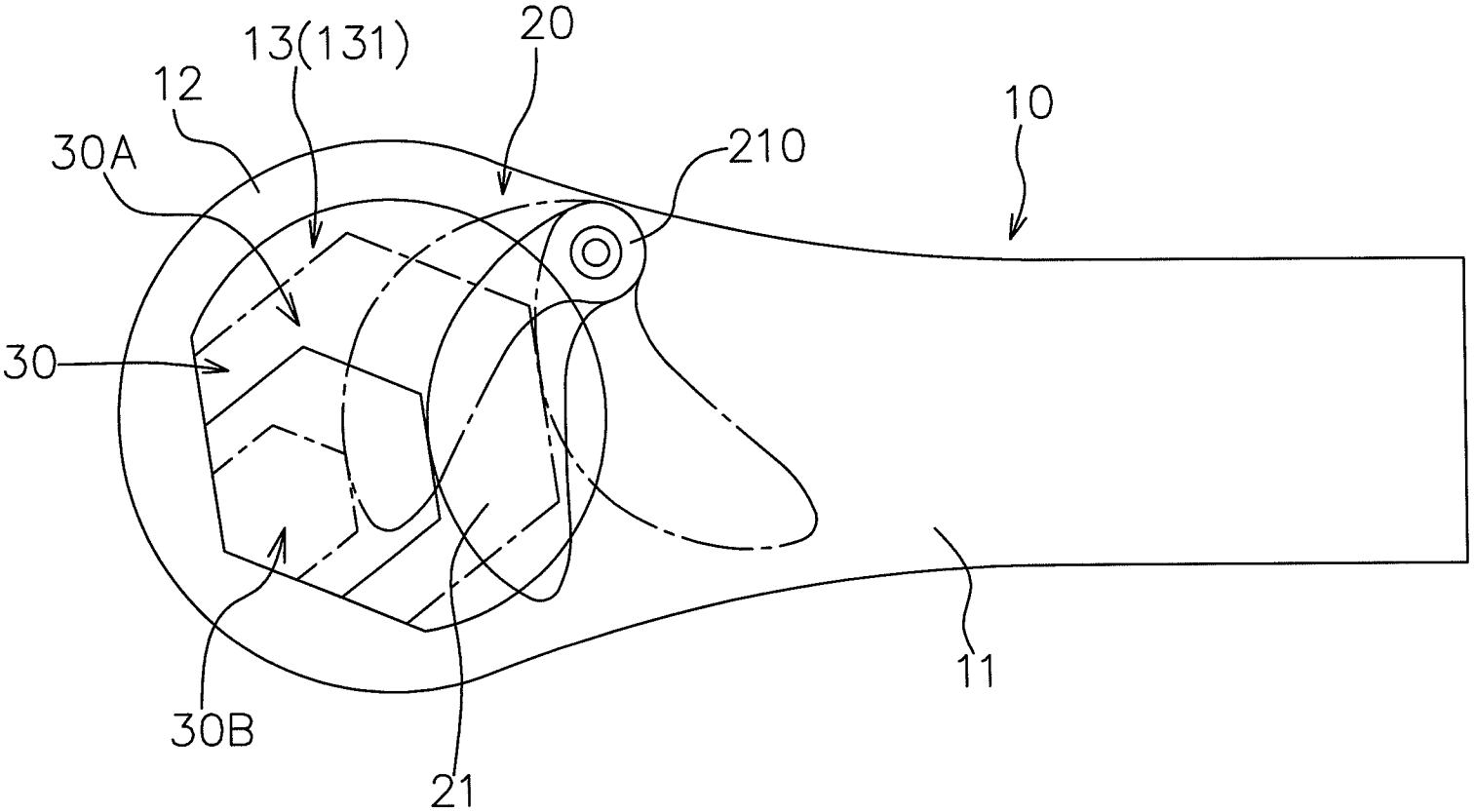
FIG. 6 is the schematic illustration of the present invention of a ratchet wrench applicable to multi-size workpieces.

What is claimed is:

1. A ratchet wrench applicable to multi-size workpieces, comprising:

a wrench, a support portion, and a resilient member, wherein the wrench has a handle and a head on which there is a hollow handle hole with two bended neighboring surfaces on its inner edge, a first support surface, and a second support surface, the head having an accommodating space and an arc-edge surface, the accommodating space being beside the hollow handle hole and embedded into the handle, the arc-edge surface being along the hollow handle hole's edge and contiguous to the first support surface, and an end of the arc-edge surface which is far away from the first support surface being adjacent to the accommodating space;

wherein the support portion has a ratchet part having two portions on opposite ends, the two portions being an arc-convex portion and art arc-concave portion, the ratchet part dividing the hollow handle hole into a first working space and a second working space which correspond to the arc-convex portion and the arc-concave portion, respectively, and a screw fastening element to be handled being placed in the first working space and contacted by the arc-convex portion of the ratchet part; and wherein the resilient member always exerts resilient resistance on the ratchet part.

2. The ratchet wrench applicable to multi-size workpieces according to claim 1, wherein both the first support surface and the second support surface are straight surfaces and form an obtuse angle therebetween.

3. The ratchet wrench applicable to multi-size workpieces according to claim 2, wherein the obtuse angle is 120 degrees.

4. The ratchet wrench applicable to multi-size workpieces according to claim 1, wherein the handle is further provided with a pivot hole penetrating the accommodating space and the ratchet part is provided with a pin joint part at one end and a pin joint hole inside, both of which are connected by a pin.

5. The ratchet wrench applicable to multi-size workpieces according to claim 4, wherein a support portion of the accommodating space is on an area of the accommodating space contiguous to the pivot hole, and a support portion of the ratchet is on an area of the ratchet part adjacent to the pin joint hole.

6. The ratchet wrench applicable to multi-size workpieces according to claim 5, wherein the resilient member wound on the pin has both ends resisting and contacting both the support portion of the accommodating space and the support portion of the ratchet.

* * * * *